United States Patent [19]

Matsunawa et al.

[11] Patent Number: 4,733,306

[45] Date of Patent: Mar. 22, 1988

[54] METHODS OF DISCRIMINATING AND COPYING AN IMAGE

[75] Inventors: Masahiko Matsunawa; Yoshinori Abe, both of Hachioji, Japan

[73] Assignee: Konishiroku Photo Industry Co., Ltd., Tokyo, Japan

[21] Appl. No.: 10,500

[22] Filed: Feb. 3, 1987

Related U.S. Application Data

[63] Continuation of Ser. No. 703,522, Feb. 20, 1985, abandoned.

[30] Foreign Application Priority Data

| | | | |
|---|---|---|---|
| Feb. 20, 1984 | [JP] | Japan | 59-29791 |
| Feb. 20, 1984 | [JP] | Japan | 59-29792 |
| Feb. 20, 1984 | [JP] | Japan | 59-29793 |
| Feb. 20, 1984 | [JP] | Japan | 59-29794 |
| Feb. 20, 1984 | [JP] | Japan | 59-29795 |
| Feb. 20, 1984 | [JP] | Japan | 59-29796 |
| Feb. 20, 1984 | [JP] | Japan | 59-29797 |

[51] Int. Cl.[4] ..... H04N 1/23

[52] U.S. Cl. ..... 358/280; 358/283

[58] Field of Search ..... 358/280, 283

[56] References Cited

U.S. PATENT DOCUMENTS

| | | | |
|---|---|---|---|
| 4,556,916 | 12/1985 | Matsunawa | 358/283 |
| 4,578,712 | 3/1986 | Matsunawa | 358/283 |

*Primary Examiner*—Michael A. Masinick

*Attorney, Agent, or Firm*—Jordan B. Bierman

[57] ABSTRACT

A method of discriminating an image by scanning an original image with a photoelectric conversion device, quantizing an image signal obtained through the photoelectric conversion device, preparing a density histogram corresponding to the quantized image signal, detecting a peak density value corresponding to the peak present on the low-density side of the density histogram and a density width of the density histogram, and discriminating the original image according to both the peak density value and the density width.

22 Claims, 18 Drawing Figures

| d \ x | ① | ② |
|---|---|---|
| (I) | VS VI | VO |
| | EXP N | N |
| | VB N | N |
| (II) | VS VI | VO |
| | EXP N | N |
| | VB N | N |
| (III) | VS VI | VO |
| | EXP L | L |
| | VB N | N |
| (IV) | VS VI | VI |
| | EXP L | L |
| | VB H | H |
| (V) | VS VI | VI |
| | EXP L | L |
| | VB L | H |

| d \ x | ① | ② |
|---|---|---|
| (I) | Vs Vl<br>Exp N | Vo<br>N |
| (II) | Vs Vl<br>Exp N | Vo<br>N |
| (III) | Vs Vl<br>Exp L | Vo<br>L |
| (IV) | Vs Vl<br>Exp L | Vo<br>L |
| (V) | Vs Vl<br>Exp L | Vl<br>L |

| d \ X | ① | ② |
|---|---|---|
| (I) | Exp N<br>VB N | N<br>N |
| (II) | Exp N<br>VB N | N<br>L |
| (III) | Exp L<br>VB N | L<br>L |
| (IV) | Exp L<br>VB N | L<br>L |
| (V) | Exp L<br>VB L | L<br>H |

FIG. 16

| d \ x | ① | ② |
|---|---|---|
| (I) | Exp N | L |
| (II) | Exp L | L |

FIG. 17

| d \ x | ① | ② |
|---|---|---|
| (I) | N | L |
| (II) | H | N |

FIG. 18

| d \ x | ① | ② |
|---|---|---|
| (I) | VS VI<br>VB N | VI<br>N |
| (II) | VS VC<br>VB N | VC<br>H |

METHODS OF DISCRIMINATING AND COPYING AN IMAGE

This is a continuation of Ser. No. 703,522 filed Feb. 20, 1985, now abandoned.

BACKGROUND OF THE INVENTION

1. Field of the Invention

The present invention relates to a method of discriminating an image, by which an image is discriminated on the basis of the data which is the image information obtained by photoelectrically scanning the image, and to a method of copying the image, and more particularly it relates to a method of discriminating an image, which, e.g., in copying an original, is based on finding the original's characteristics as the to what conditions should be selected for copying the original, and to a method of copying the image, in which the copying conditions of a copying apparatus is determined in accordance with the method of discriminating an image.

2. Description of the Prior Art

In copying apparatus or other equivalents, control systems for controlling copy densities according to the original's densities have already been devised and are now made practical reality. The image discriminating method used in such systems includes those which control the density condition according to the maximum value or the minimum value of the original's densities and those which control the density condition according to the mean value of the original's densities. In these methods, however, since it is difficult to make accurate image discrimination, unsatisfactory density control has been carried out.

On the other hand, an attempt has been made to form a density histogram with the density values from sampled pieces of image information to thereby perform image discrimination {for example, as disclosed in Japanese patent publication Open to Public Inspection (hereinafter referred to as Japanese Patent O.P.I. Publication) No. 45564/1982}. This method has an advantage over the above-mentioned methods in respect of the improvement of the image discrimination accuracy. However, this method also has a problem which is such that the discrimination accuracy is insufficient, or even if sufficient the procedure of the discrimination is troublesome.

Also, for the copying system wherein the copying conditions are determined by discriminating the original image, the following control algorithm has been devised: That is, an original image is in advance scanned to form a density histogram, from which the minimum density is found. The minimum density is then used to thereby determine the development bias voltage; provided, however, if the minimum density value is less than a given value, the development bias voltage is to be determined according to the density range, the width of the density histogram.

The copying method of the above control algorithm, however, has the disadvantage that, since the background density is detected from the minimum density level, if the original to be copied is one such as a blue print whose background is uneven in its density, the resulting copy image tends to produce a background fog. The method has an additional problem that, in the case of a low-density color background line-drawing original, even if the background fog is removed, the lines are reproduced with their density remaining low, so that the image becomes indistinct or illegible, and by contrast with this, if the image is reproduced in trying to make its contrast greater the background fog becomes conspicuous. The above method has a further problem that, if a gradational image, particularly one having a lot of high-density portions (black-and-white or color image) is copied, the copied image tends to become a solid-black or dark image because it takes no account of the image gradation.

OBJECT AND SUMMARY OF THE INVENTION

The present invention has been made in view of these problems.

It is an object of the present invention to provide a method of discriminating an image, which is capable of discriminating an image accurately in a simple manner, and a method of copying an image, which is capable of making satisfactory image copies even from a gradational original image; in other words, the methods enable the gradation conversion for a gradational image and the high-contrast and background fog-free reproduction of a line-drawing image.

What has accomplished the above object is this invention. The invention is characterized by a method of discriminating an image which comprises scanning an original image; quantization of an image signal obtained through the photoelectric conversion and read-out of the scanned image; preparation of a density histogram corresponding to the quantized image signal; detection from the density histogram of the peak density value corresponding to the peak present on the low-density side of the density histogram; detection also of the density width of the same density histogram; and discriminating the original image from both the peak density value and the density width; and also by a method for copying the image which comprises control of at least one of or a combination of the set values of the conditions of the charging, exposure and developing processes according to both the above peak density value and the density width; and copying the original image under the above density control (ex. tone correction).

BRIEF DESCRIPTION OF THE DRAWINGS

FIG. 16 is an explanatory drawing of a fourth example showing a table of selection of values for the density control.

FIG. 17 is an explanatory drawing of a fifth example showing a table of selection of values for the density control.

FIG. 18 is an explanatory drawing of a sixth example showing a table of selection of values for the density control.

DESCRIPTION OF THE PREFERRED EMBODIMENTS

The present invention will be illustrated in detail below by making reference to the construction and function of the apparatus which practices the method of discriminating an image in the invention.

Figure 1:
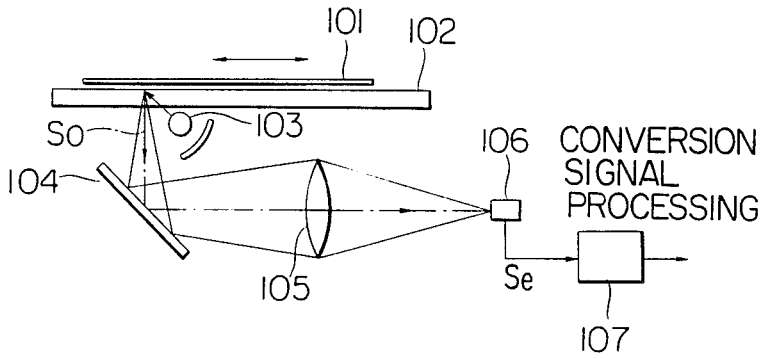
FIG. 1 is a drawing showing the principal part of the apparatus which practices the image discriminating method of this invention.

FIG. 1 is a block drawing showing an example of the apparatus which practices the method of this invention. In the drawing, 101 is an original, and 102 is a transparent document glass plate, which is reciprocatingly movable in the direction of arrows. 103 is a light source. Tugnsten lamp, sodium vapor lamp, fluorescent lamp, iodine lamp, laser light, light emission diode, or the like, may be used for the light source 103. 104 is a mirror which conducts the light from the original exposured by light source onto a condenser lens 105. 106 is a photoelectric conversion device (image sensor, photoelectric conversion element). An image sensor such as CCD, phototransistor, photodiode, CdS cell, or these in the array form may be used. If condenser lens 105 is used as in a example of this invention, photoelectric conversion element 106 should be arranged inside the luminous flux converged by condenser lens 105 of the light reflected from original 101. 107 is a signal processing section (unit), which processes various signals for the image discrimination after receiving image signal Se, the electric output produced when the light-quantity signal So corresponding to the original image is photoelectrically converted by photoelectric conversion element 6.

Figure 2:
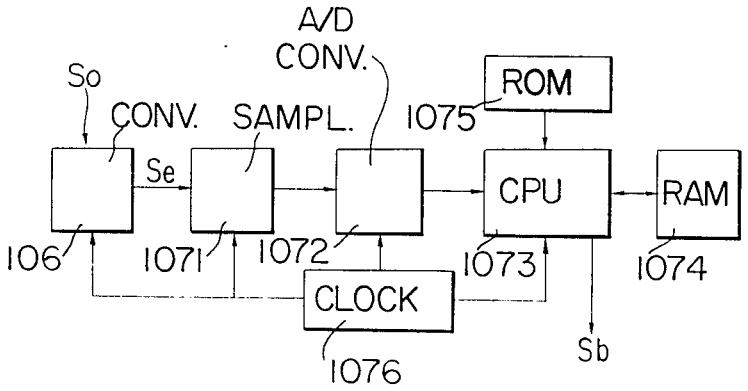
FIG. 2 is a block diagram of the signal processing section provided in FIG. 1.
Figure 3:
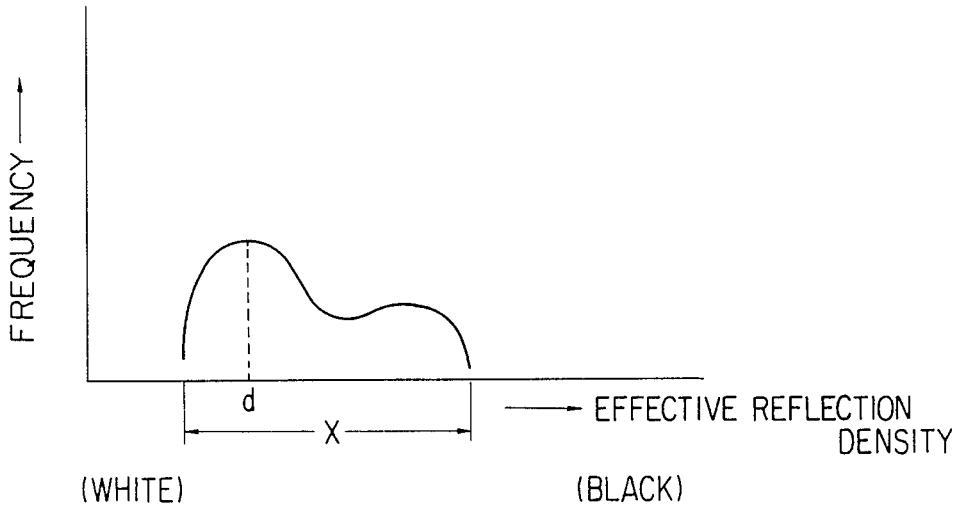
FIG. 3 is an explanatory drawing with respect to the low-density-side peak level density and the width of the density histogram which become the discriminating basis in the image discriminating method of the present invention.

A block diagram including the above-mentioned signal processing section 107 and the peripheral circuits thereof is shown in FIG. 2. In this figure, 106 is the above photoelectric conversion element for converting the incident light-quantity signal So into an electric image signal Se. 1071 is a sampling circuit of image signal Se. The sampling circuit 1071 is arranged so as to perform not peak sampling but constant time interval sampling for ease of grasping the nature of an image on the whole. 1072 is an A/D converter for converting an analog signal from sampling circuit 1071 into a digital signal. The level of an output from the sampling circuit 1071 produced when the upper-limit density (e.g., effective reflection density of 0.8) of the low-density area of an original is scanned is adjusted so as to reach the 50–80% level from the low-level side of the input width of the A/D converter 1072, This is made in order that even a slight difference in the background density on the density histogram can be detected by finely quantizing the low-density area. 1073 is a central processing unit (hereinafter called CPU), such as a microprocessor, which prepares a density histogram in accordance with the data from A/D converter 1072 and performs the image discrimination from the density histogram. 1074 is a memory (RAM) which stores the data from CPU 1073, and further supplies the stored data to CPU 1073. 1075 is a memory (ROM) for the storage of the operational program or other programs for CPU 1073. And 1076 is a reference clock generating section, which produces a pulse to control the light-receiving time of photoelectric conversion element 106, a clock signal that determines the operational timing of A/D converter 1072, and a clock signal that determines the operational timing, data or program-send or -call timing of CPU 1073. The image discrimination in the above CPU 1073 is performed in accordance with the peak density on the low-density side of the density histogram (the density corresponding to the peak produced on the lowest density side of the histogram) and the histogram density width. For example, in the case where a density histogram as in FIG. 3 is obtained, the image discrimination is made on the basis of the low-density-side peak level density d and the width of density histogram (histogram density width) X. That is, CPU 1073 performs judgement to find how much background density the image has and what histogram equalization the image requires. In addition, all the above components 1071 through 1076 form a signal processing section 107.

Hereupon, the form of the density histogram changes according to the size of the unit pixel of photoelectric conversion element 106 (the read-out spot area on an original image; hereinafter called "spot"). For example, the time-series pattern of the light-quantity signal (effective reflection density) corresponding to the image density obtained when an original image (the region to be judged) is scanned by a small spot, in the case of a line-drawing, becomes a pattern of a number of high-density signals being scattered among the major low-density signals, while in the case of tonal image, becomes a pattern having a distribution of high-, medium- and low-density signals relatively mixed. In contrast to this, the time-series pattern of the light-quantity signal (effective-reflection density) of the image density obtained when the spot area is relatively extended, in the case of a line drawing, shows a rapid decrease in the high-density signals as compared to that of the above small spot, while in the case of a gradational image, shows little change.

Figure 4:
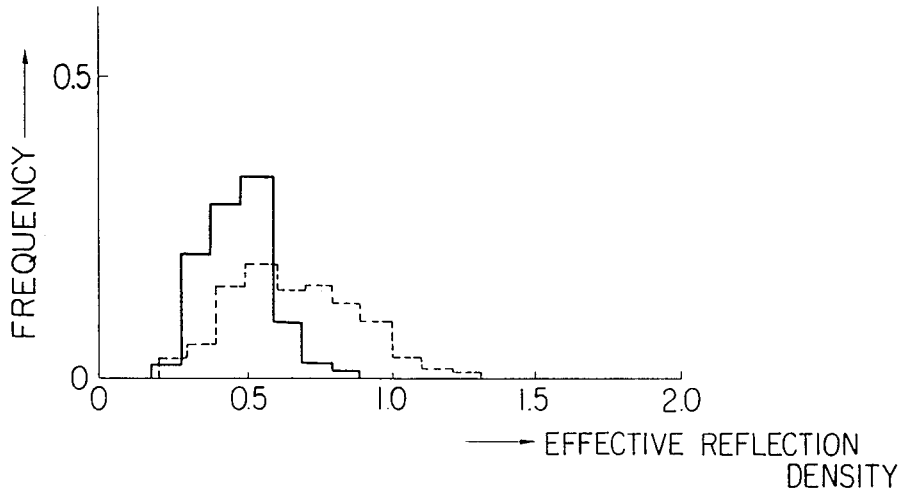
FIG. 4 is an explanatory drawing of the width of the density histogram with respect to the image scanned by small spot.
Figure 5:
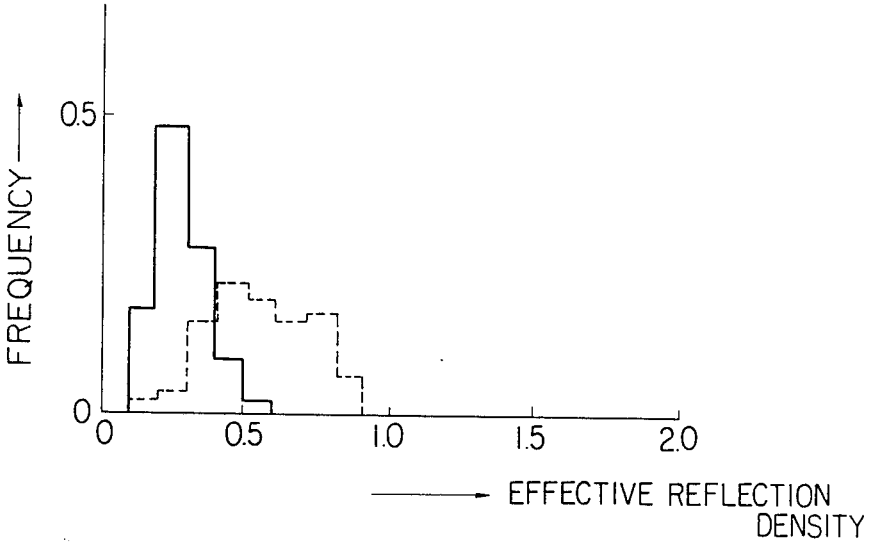
FIG. 5 is an explanatory drawing of the width of the density histogram with respect to the image area scanned of large spot.

Next, the difference in the effective density histogram according to the size of the spot will be explained in detail below: FIG. 4 and FIG. 5 are histograms (density histogram by density data read-out every effective reflection density of 0.1) obtained by scanning a character image (line drawing) and a photo image (tonal image) of a certain newspaper at regular 1 mm intervals with a 0.1 mm-square (0.01 $mm^2$) spot and a 2 mm$\phi$ (3.14 $mm^2$) spot, respectively. Shown with a solid line is the histogram obtained from the character image (line drawing), while shown with a broken line is the histogram from the photo image (tonal image). As is apparent by comparison between both drawings, in the line drawing, the maximum peak of the histogram by the 2 mmϕ spot shifts far more greatly toward the low-density side than does by the 0.1 mm-square spot, while in the tonal image, the difference in the shift of the maximum peak is small. Since this situation changes little even when the sampling interval is varied as 0.3 mm, 0.9 mm, 1.0 mm or 1.5 mm, the above remarkable difference in the shift is considered caused by the spot size. The unit density histogram width of the histogram can be taken arbitrarily; even if taken otherwise, similar shift phenomenon of the above maximum peak is still observed. Accordingly, what spot size should be selected comes into question, particularly in the case of line drawing; it is necessary to select a spot size that enables to obtain a steep peak so that the peak density on the low-density side can be clearly found even when the low-density side is finely quantized. From this point of view, the spot size is desirable to be not less than 0.1 $mm^2$.

Reference is now made to the signal processing in the above apparatus. Light-quantity signal So is first converted by photoelectric conversion element 106 into an electric image signal Se, which is then sampled by sampling circuit 1071. Analog signal Se is then converted by A/D converter 1072 into a digital signal. The digitalized image signal is inputted to CPU 1073, and by means of memories 1074 and 1075, subsequently performs the forming a density histogram and discriminating of the image, whereby an output of image discriminating signal Sb is produced from the CPU 1073.

To take an electrophotographic copying apparatus in the Carlson process as an example, the copy image density is controlled in accordance with the above image discriminating signal Sb. For example, in the case where the peak density (density value of histogram peak) on the low-density side is low and the histogram density width is narrow, i.e., in the case of FIG. 6(A), since the image is considered to be a low-density or colored-background line drawing, the histogram equalization is to be performed for copying the image {see FIG. 6(B)}. Accordingly, it is necessary to:

(1) increase the surface potential of the drum, (2) adjust the quantity of light to a medium or slightly high level, and (3) adjust the developing bias voltage to a medium level.

Now, since the image density change characteristics due to changes in the surface potential, quantity of light in exposure, developing bias voltage, etc., are generally known and out of the scope of this invention, the description of them will be excluded herefrom.

The detecting of the peak density on the low-density side and histogram density width only has been described above, but where a plurality of peaks are present on the histogram, it is also possible to find, for example, the peak density present on the high-density sie in addition to the peak density on the low-density side. According to this method, the image discriminating accuracy can be further improved, for example, it becomes also possible to make a histogram equalization that extends the high-density area of a tonal image rich in high-density portions toward the low-density area. Also, not only the peak level density but also the peak value of the histogram may be found to be provided for the image discrimination. By doing so, because the principal density of an image (the density of the desired part of an image) can be recognized well, such an operation that the histogram equalization is concentrated upon the part can be carried out.

Further, as the histogram density width in the above description, a width at a given offsetted frequency may be also be used.

As has been described above, according to the image discriminating method of this invention, the peak density on the low-density side can be accurately found by the fine quantization, and therefore a correct image discrimination can be made by judging what background density level the image has. Since the histogram density width is used also as the basis for the image discrimination, judgement can be made on what histogram equalization is required for the image. Consequently, the use of the method of this invention enables the reproduction of a high quality copy image.

Figure 7:
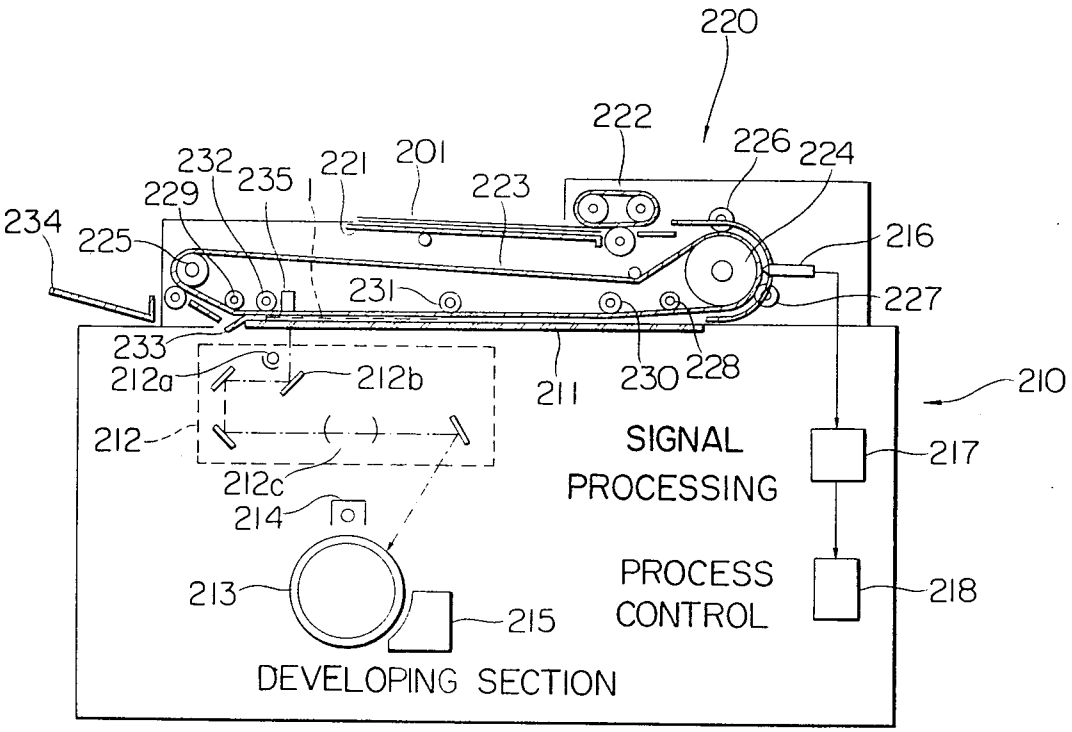
FIG. 7 is a constructional drawing showing the principal part of an example of the copying apparatus which practices the copying method of this invention.

The copying method of the present invention will now be described in detail below:

FIG. 7 is a constructional drawing of an example of the copying apparatus practicing the copying method of this invention. In the drawing, 210 is the body of a copying apparatus and 220 is an automatic original feed section (automatic document feeder). In the body 210, 211 is a document glass plate (original carrier plate) on which an original 201 is placed. 212 is an optical system which shows the passage of the light from light sourc 212*a* onto the original 201 placed on document glass plate 211 and leads the reflected light through mirrors 212*b* and through lens 212*c*, etc., to a photoreceptor drum 213. Photoreceptor drum 213 is uniformly charged by a charging electrode 214, and exposed as before mentioned, then the electrostatic latent image formed on the surface of photoreceptor drum 213 is developed in a developing section (unit) 215. 216 is a photoelectric conversion element (device) which receives the reflected light through a condenser lens (not shown) from the original. As the photoelectric conversion element 216, a solid state image sensor such as, for example, CCD, photodiode array, etc., or an ordinary photosensor, phototransistor, or the like, may be used. In the example of this invention, such the image sensor is comprised of a number of picture elements, which are arranged so as to be aligned in the vertical direction in the drawing shown as FIG. 7, and the main scanning is made by reading sequentially the output from each picture element. In addition, the subscanning is made by the feed of original 201. 217 is a signal processing section which receives an image signal Se that has been photoelectrically converted by image sensor element 216 to thereby process various signals necessary for the image discrimination.

Figure 8:
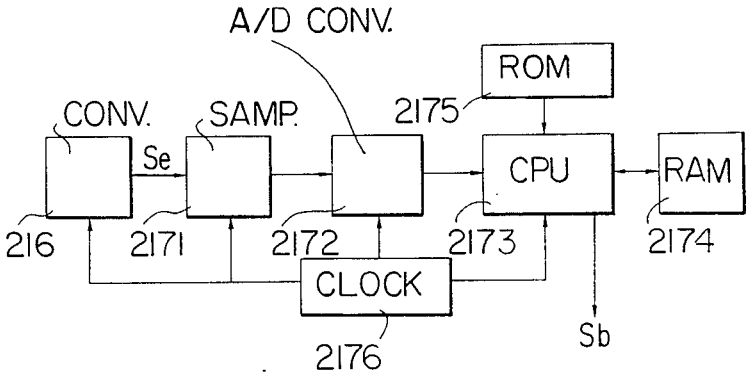
FIG. 8 is a block diagram of the signal processing section provided in FIG. 7.
Figure 9:
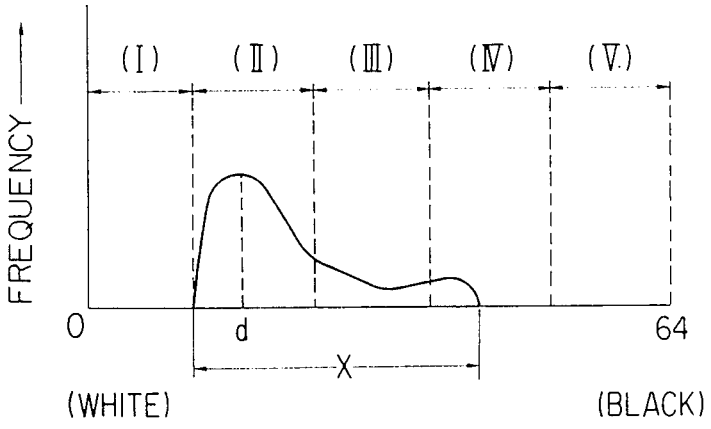
FIG. 9 is an explanatory drawing of an alternative form of FIG. 3.

The block diagram of the above signal processing section 217 and the peripheral circuits thereof is shown in FIG. 8, wherein 216 is the above-mentioned image sensor wich converts the incident light-quantity signal into an electric image signal Se, and 2171 is a sampling circuit for image signal Se. Sampling circuit 2171 is constructed so a to perform not peak sampling but constant time interval sampling because of ease of grasping the nature of the image on the whole. 2172 is an A/D converter for converting the analog ignal from sampling circuit 2171 into a digital signal. The level of the output from sampling circuit 2171 produced when the upper-limit density (e.g., effective reflection density of 0.8) of the low-density area of the original is scanned is adjusted so as to reach the 50–80% level from the low-level side of the input width of A/D converter 2172. This is made in order that even a slight difference in the background density of the density histogram can be detected by finely quantizing the low-density area. 2173 is a central processing unit (hereinafter called CPU), such as a microprocessor, which prepares a density histogram in accordance with the output data from A/D converter 2172 and performs the image discrimination from the density histogram. 2174 is a memory (RAM) which collects and stores the data from CPU 2173, and further supplies the stored data to CPU 2173. 2175 is a memory (ROM) for the storage of the operational program or other programs for CPU 2173. Further, 2176 is a reference clock generating unit, which produces a pulse to control the light-receiving time of photoelectric conversion element 216, a clock signal that determines the operational timing of A/D converter 2172, and a clock signal that determines the operational timing, data or program-send or -call timing of CPU 2173. The image discrimination in the above CPU 2173 is performed in accordance with the peak density on the low-density side of the density histogram (the density corresponding to the peak produced on the lowest-density side of the histogram) and the histogram density width, for example, in the case where a density histogram as in FIG. 9 (on the axis of abscissa are shown the level numbers 0–64 corresponding to the effective reflection densities) is obtained, the image discrimination is made on the basis of the low-density side peak density d and the histogram density width X. That is, CPU 2173 performs judgement to find how much background density the image has and what histogram equalization is required for the image. To be concrete, as is shown in FIG. 9, the axis of the abscissa (effective reflection density) is divided into a plurality of density ranges (5 ranges in FIG. 9; hereinafter described in accordance with this example), and the image discrimination is made by detecting which range the peak density d on the low-density side lies in and what value the histogram density width X is (in FIG. 9, when the white-black range is divided into 64 levels, the X is judged on whether (1) it is wider than the 10-level equivalent or (2) narrower than the 10-level equivalent; the description will be continued hereinafter in accordance with this example). And the image discriminating signal Sb output is produced which determines the charging, exposure and developing conditions in accordance with a combination of (I) to (V) with (1) or (2). In addition, the above components 2171 through 2176 form the signal processing section 217.

Hereupon, the form of the density histogram changes according to the size of spot. For example, the time-series pattern of the light-quantity signal (effective reflection density) corresponding to the image density obtained when an original image (the region to be judged) is scanned by small spot, in the case of a line drawing, becomes a pattern of one or a small number of high-density signals being scattered among the major low-density signals, while in the case of a tonal (gradational) image, becomes a pattern having a distribution of high-, medium- and low-density signals relatively mixed. In contrast to this, the time-series pattern of the light-quantity signal (effective reflection density) of the image density obtained when the spot area is relatively extended, in the case of a line drawing, shows a rapid decrease in the high-density signals as compared to that of the above small spot, while in the case of a tonal image, shows little change. Next, the difference in the effective density histogram according to the size of the spot will be explained in detail below:

FIG. 4 and FIG. 5 are histograms (density of 0.1 is used as unit density histogram width) obtained by scanning a character image (line drawng) and a photo image (tonal image) of a certain newspaper at constant 1 mm intervals with a 0.1 mm-square 0.01 $mm^2$) spot and a 2 mmϕ (3.14 $mm^2$) spot, respectively. Shown with a solid line is the histogram obtained from the character image (line drawing), while shown with a broken line is the histogram from the photo image (tonal image). As is apparent by comparison between both drawings, in the line drawing, the maximum peak of the histogram by the 2 mmϕ spot shifts far more greatly toward the low-density side than does that by the 0.1 mm-square spot, while in the tonal image, the difference in the shift of the maximum peak is small. Since this situation changes little even when the sampling interval is varied as 0.3 mm, 0.9 mm, 1.0 mm or 1.5 mm, the above remarkable difference in the shift is considered caused by the spot size. The unit density histogram width can be taken arbitrarily; even if taken otherwise, similar shift phenomenom of the above maximum peak is still observed. Accordingly, what spot size should be selected comes into question, particularly, in the case of a line drawing; it is necessary to select a spot size that enables to obtain a steep peak so that the peak density on the low-density side can be clearly found even when the low-density side is finely quantized. From this point of view, the spot size is desirable to be not less than 0.1 $mm^2$.

Figures 10, 11:
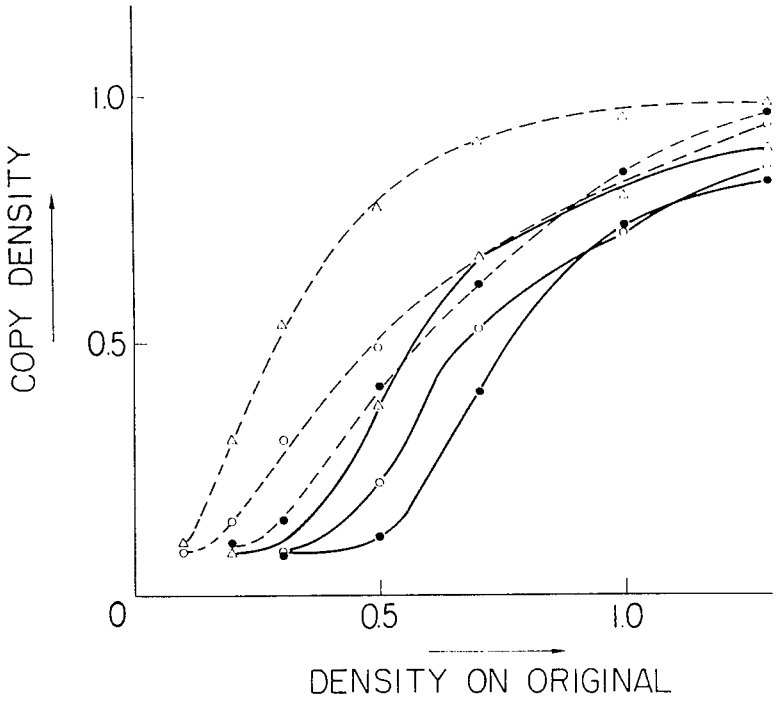
FIG. 10 is an explanatory drawing of a first example showing a table of selection of values for the density control.
FIG. 11 is a drawing showing the relations between the original image density and the copy image density.

218(I) is a process control section that receives the image discriminating signal Sb from the foregoing signal processing section 217(I), and determines the charging, exposure and developing conditions in accordance with the image discriminating signal Sb. Process control section 218(I), in addition to this, performs various controls such as the control of the feed operation by automatic original feed device 220, the control of the motion of optical scanning system 212, and the like. The controls of the charging, exposure and developing conditions by the process control section 218(I) are accomplished by the control of the charging current (the surface potential of photoreceptor drum 213), the control of quantity of light, and control of the developing bias voltage. Light source 212*a* is driven usually by a known light adjusting circuit comprised of a trigger diode and triode AC switch, etc. In this instance, the quantity of light from light source 212*a* can be controlled by phase control. FIG. 10 shows an example of the surface potential Vs, quantity of light Ex and developing bias volta $V_B$ which process control section 218(I) selects according to the combination of (I) to (V) with (1) or (2) instructed by image discerning signal Sb. As for the surface potential Vs, two different voltages Vo and $V_1$ (to indicate an example of particular values, Vo=960 V and $V_1$=900 V) are given, but the quantity of light in exposure Exp and developing bias volta $V_B$ are given in relative values. That is, as for the quantity of light Exp, the "L" in the table is used for a large quantity of light, the "N" for a medium quantity, and the "D" for a small quantity. On the other hand, as to the developing bias voltage, the "L" in the table is used for a low developing bias voltage the "N" for a medium voltage, and the "H" for a high bias voltage. The table in FIG. 10 may be written in, e.g., ROM 2175, to let CPU 2173 produce an output of the above values as setting values to the process control section 218, or the process control section 218 may be provided thereinside with ROM in which is written the table of FIG. 10 to let CPU 2173 produce a signal showing a combination of (I) to (V)

with (1) or (2). The description of this invention is based on the latter construction.

Again in FIG. 7, automatic original feed device 220 comprises original feed section (original feeding member) 222 which takes in one by one the originals 201 placed on original supply tray 221; transport belt 223 which holds down the original 201 to the document glass plate 211 side and transport the original toward left hand of FIG. 7; driving roller 224 and driven roller 225 which secure the above movement of transport belt 223; pressure rollers 226 and 227 which press original 201 against transport belt 223 (at the portion of the belt in contact with driving roller 224) in order to send the original 201 which original feed section 222 took in; guide rollers 228 and 229 which regulate the principal transport path of transport belt 223; hold-down rollers 230 and 231 which are located between guide rollers 228 and 229 to press transport belt 223 toward the document glass plate 211 side; stopper 233 which serves to stop the original 201 on document glass 211 at the correct position in cooperation with stopper roller 232; ejected original receiving tray 234 onto which the read and ejected originals are to be stacked; sensor 235 whcih detects that original 201 has been set to the correct position on the document glass plate 211; and the like.

The operation of the copying apparatus of the above construction will then be illustrated below:

Originals 201 are first placed on original supply tray 221, and when the copying start button (not shown) is depressed, process control section 218 returns optical scanning system 212 to the home position (the extreme left position in FIG. 7; i.e., the exposure-scanning start position) and at the same time rotates both original feed section 222 and transport belt 223 to thereby transport the original 201 and then stops the original 201 in the proper position at the upper tip of stopper 233 that protrudes from the upper face of document glass 211 and stops also the rotation of transfer belt 223. During the transport, the original image is discriminated by both photoelectric conversion element 216 and signal process section 217. That is, the photoelectric conversion element 216 first converts the light-quantity signal into an electric image signal Se, and the image signal Se is then sampled by sampling circuit 2171, and the signal Se, an analog signal, is further converted by A/D converter 2172 into a digital signal. The digitalized image signal Se is then inputted to CPU 2173. The CPU 2173, with the aid of memories 2174 and 2175, performs the preparation of the previously mentioned density histogram and the discriminating of the image, whereby an image discriminating signal Sb is produced from the CPU 2173. The signal Sb is then fed into process control section 218. On the other hand, the setting of original 201 to the proper position also is made by sensor 235, and the signal also is fed into the process control section 218(I). When the above two signals are fed into the process control section 218(I), the process control section 218(I) provides a charge current (surface potential) according to the results of the image discrimination to the drum, and from light source 212*a* a light having a given intensity based on the results of the image discrimination is emitted and projected upon the original 201 (the light emission is allowed to start before it), and the reflected light from the original is fed through mirrors 212*b* and lens 212*c*, etc., up to photoreceptor drum 213 to thereby form an electrostatic latent image on the drum. And, in developing section 215, the latent image is developed with the application of a developing bias voltage based on the results of the image discrimination, and after that the transfer of the toner image onto a copy paper sheet (not shown), separation of the copy paper sheet from the photoreceptor drum 213, fixing of the toner image to the paper, and the like, are performed in the described order, whereby one cycle of the copying process is completed. On the other hand, in parallel with the development, separation and fixation operation, the process control section 218, after exposure, moves the upper end of stopper 233 downward from the upper face of document glass plate 211, and again rotates transfer belt 23 to eject the copying-completed original 201 to ejected original-receiving tray 234. At the same time, the transport of a new original 201 is started, and the original is set to the correct position on document glass plate 211. After that the same copying operation cycle is repeated until the completion of the copying of all the originals 201 placed on original supply tray 221.

Figures 12, 13:
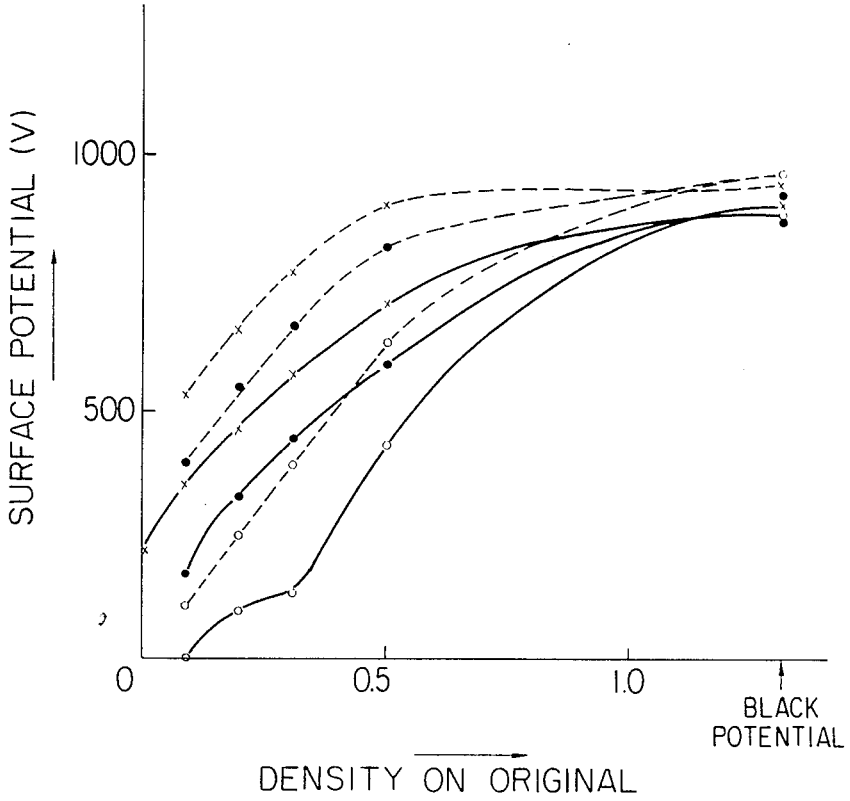
FIG. 12 is a drawing showing the relations between the original image density and the surface potential.
FIG. 13 is an explanatory drawing of a second example showing a table of selection of values for the density control.

FIG. 11 is a drawing showing the relations between the original's image density and the copy image density when the quantity of light and the developing bias voltage are varied. FIG. 12 is a drawing showing the relations between the surface potential and the copy image density when the quantity of light is varied. The solid-line curves in FIG. 11 shows the characteristics obtained by a large quantity of light, while the broken-line curves show the characteristics by a small quantity of light. Also, the curves with the are for a high developing bias voltage, the ones with the for a medium voltage and the ones with the Δ for a low voltage. On the other hand, the solid-line curves and the broken-line curves in FIG. 12 show the characteristics in the case were two different settings are made. The curves with the O are for a large quantity of light, the ones with the ● for medium quantity, and the ones with the x for a small quantity. From the above FIG. 11 it is understood that the higher the bias voltage, the higher the density of the area from which the development begins, and the larger the quantity of light, the more conspicuous the fade-out in the low-density area of the image. Also, from FIG. 12 it is understood that if the black original copying electric potential is increased, a rapid change in the potential occurs in the low-density area. This tendency increases with the increase in the quantity of light.

Figure 6:
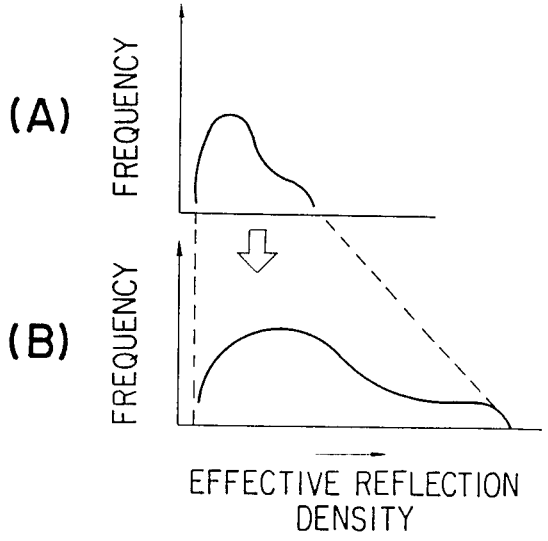
FIG. 6 is an explanatory drawing of the histogram equalization.

According to the above copying apparatus, for example, where the peak density on the low-density side is low and the histogram density width X is narrow, i.e., in the case of FIG. 6(A) (a low-density, color-background line drawing), the discrimination is to be made by selecting a combination of any one of (I) to (III) with (2), and the copying operation is to be made on condition that:

(1) the surface potential of the drum is increased to a high level, (2) the quantity of light is adjusted to a medium or a slightly high level, and (3) the developing bias voltage is set to a medium level.

Accordingly, fog-free, histogram equalization-treated copies can be obtained {see FIG. 6(B)}.

And, for an original image showing a histogram shifted toward the high-density side, a combination of (IV) or (V) with (2) is to be selected, and thus a histogram equalization wherein the high-density area is extended toward the low-density side is made, whereby the image will never become of a solid-black copy.

In addition, described above is for the finding of the peak density on the low-density side and the histogram density width X only, but it is also possible to find other peak densities in addition to the above. According to this method, the image discriminating accuracy can be improved, for example, it is possible to perform a histogram equalization that extends the high-density area in a tonal image rich in high-density details (low-density details are also contained) toward the low-density side. Also, not only the peak density but the peak value of the histogram may be found to be provided for the image discrimination. By doing so, because the principal density (the density of the desired part) of the image can be recognized well, such a copying operation that the histogram equalization is concentrated upon the part can be carried out.

And, as the histogram density width in the above description a width at a given offsetted frequency may also be used.

Further, the above description has been made with respect to one in which the photoelectric conversion devise 216 does not move in the scanning for the image discrimination (the element of the image sensor is in the array form), but there is no need of limiting the element to the above one. For example, the following construction may also be used: the main scanning is made by scanning an original image 201 with a laser beam, and the reflected light from the original 201 is led through a light-guiding member such as an optical fiber, or a light-converging member, to a photosensor having a simple light-receiving plane.

The above example, although described for a copying apparatus having a automatic document feeder may also be practiced in those generally used copying machines even if they are of the glass plate movable type or fixed type. And there is no need of limiting their copying process to the ordinary Carlson process.

As has been described above, according to the present invention since the peak density on the low-density side can be correctly found because of the fine quantization, the image discrimination can be made accurately by judging what background density level the image has, and therefore a quality image can be reproduced without producing any background fog, and further, because the conversion of image gradation can be carried out, a well-legible, good-quality image can be obtained.

Now, a second example of the copying method of this invention will be illustrated below:

In the copying apparatus shown in the foregoing FIG. 7, 218(II) is a process control section which receives an image discriminating signal Sb from the foregoing signal processing section 217(II), and determines the charging and exposure conditions based on the signal Sb. The process control section 218(II), in addition to the above, performs various controls such as the control of the feed operation by automatic document feeder 220, the control of the movement of optical scanning system 212, and the like. The controls of the charging and exposure conditions by process control section 218(II) are accomplished by the control of the charge current (the surface potential of drum 213) and the control of the quantity of light (Light source 212 is driven usually by a known light adjusting circuit which uses a trigger diode, triode AC switch, etc. In this case, the quantity of light from light source 212 can be controlled by phase control). FIG. 13 shows an example of the surface voltage Vs and quantity of light, Exp which the process control section 218(II) selects in accordance with a combination of (I) to (V) with (1) or (2) instructed by image discriminating signal Sb. As for the surface potential Vs, two different voltages Vo and $V_1$ (to indicate an example of particular values, Vo=960 V and $V_1$=900 V) are shown, while as to the quantity of light Exp, the values are shown with relative values. That is, as to the quantity of light, Exp, the "L" in the table is used for a large quantity of light, the "N" for a medium quantity, and the "D" for a small quantity. The table in FIG. 13 may be written in, e.g., ROM 2175, to let CPU 2173 produce the above values as the setting values to the process control section 218, or inside the process control section is provided ROM in which is written the above table to let CPU 2173 produce a signal showing a combination of (I) to (V) with (1) or (2). The description of the invention is based on the latter condition. Now the operation of the copying apparatus according to this example will be illustrated below:

Originals 201 are first placed on original supply tray 221, and when the copying start button (not shown) is depressed, process control section 218 returns optical scanning system 212 to the initial position (home position) thereof (the extreme left position in FIG. 7, i.e., the exposure-scanning start position), and at the same time rotates both original feed section 222 and transport belt 223 to transport original 201, and then stops the original 201 in the proper position at the upper end of stopper 233, and also stops the rotation of transport belt 223. During this transport, both photoelectric conversion element 216 and signal processing section 217 discriminate the image of the original. That is, the photoelectric conversion element 216 first converts the light-quantity signal into an electric image signal Se, and the image signal Se is sampled by sampling circuit 2171, and the Se, an analog signal, is then converted by A/D converter 2172 into a digital signal. The digitalized image signal Se is read out by CPU 2173. The CPU 2173, with the aid of memories 2174 and 2175, performs the preparation of the foregoing histogram and the image discrimination, and then produces an image discriminating signal Sb output. The image discriminating signal Sb is then fed into process control section 218. On the other hand, the setting of original 201 to the proper position also is made by sensor 235 at the same time, and a signal also is fed into the process control section 218(II). Upon the input of the above two signals to the proces control section 18(II), the process control section 218(II) provides a charge current (surface potential) based on the results of the image discrimination to the drum. And from light source 212 a light of a given intensity based on the results of the image discrimination is emitted and projected upon the original 201 (the light emission may be started before it), and the reflected light from the original is led through mirrors **212*b* and lens 212*c* onto photoreceptor drum 213, whereby an electrostatic latent image is formed on the drum. The electrostatic latent image is then developed in developing section 215, and after that, the transfer of the toner image onto a copy sheet (not shown), separation of the copy sheet from the photoreceptor drum 213, and fixing of the toner image to the sheet are performed, whereby one cycle of the copying process is completed. On the other hand, in parallel with the developing, separation and fixing operations, the process control section 218, after exposure, moves the upper end of stopper 233 downward from the upper face of document glass plate 211, and again rotates transport belt 223 to eject the copying-completed original 201 to ejected original-receiving tray 234, ant at the same time, commences the transport of a new original 201 and sets it to the correct position on document glass plate 211. After that, the same copying operation cycle is repeated unitl the completion of the copying of all the originals stacked on original supply tray 221**.

Now, the foregoing FIG. 11 is indicated also as a drawing showing the relations between the original image density and the copy image density when the quantity of light is varied, and FIG. 12 is a drawing showing the relations between the surface potential and the original image density when the quantity of light is varied. The solid-line curves in FIG. 11 show the characteristics obtained when a large quantity of light is used, while the broken-line curves show the characteristics obtained when a small amount of light is used. The curves with the ○ are for the case where a high developing bias voltage is used, the ones with the ● for a medium bias boltage, and the ones with the Δ for a low bias voltge. On the other hand, the solid-line curves and the broken-line curves in FIG. 12 show the characteristics obtained in two different settings. In this figure, the curves with the ○ are for the case where a large quantity of light is used, the ones with the ● for a medium quantity of light, and the ones with the x for a small quantity of light. From FIG. 11 it is understood that the larger the quantity of light, the more conspicuous the fade-out in the low-density area of the image. And from FIG. 12 it is understood that if the black original copying electric potential is increased, a rapid change in the potential occurs in the low-density area, and this tendency increases with the increase in the quantity of light.

According to the above copying apparatus, for example, in the case where the peak density d on the low-density side (density d corresponding to the peak produced on the low-density side of the histogram) is low and the histogram density width X is narrow; that is, in the case of FIG. 6(A) (low-density or color-background line drawing), the image discrimination is to be made by the selection of a combination of any one of (I) to (III) with (2), and the copying operation is to be made on condition that:

(1) the surface potential of the drum is increased to a high level, and
(2) the quantity of light is set to a medium or slightly high level, whereby fog-free, histogram equalization-treated copies can be obtained {see FIG. 6(B)}.

Also, for an original image whose histogram is shifted toward the high-density side, a combination of (IV) or (V) with (2) is to be selected, and thus a histogram equalization where the high-density area is extended toward the low-density side is to be performed, and therefore the image will never be of a solid-black copy.

In addition, the above description has been made with respect to the finding of the peak density on the low-density side and the histogram density width only, but it is possible to find other peak densities along with them. According to this method, the image discriminating accuracy can be improved, for example, it makes possible a histogram equalization that extends the high-density area of a tonal image rich in high-density details (also containing low-density details) toward the low-density side. And not only the peak density but the peak value of the histogram may be found to be provided for the image discrimination. By doing so, the principal density (the density of the desired details) of the image can be recognized well, whereby the copying operation wherein the histogram equalization is concentrated upon the principal density can be performed.

Also, as the width of density histogram (histogram density width) in the above description a width where is made at a given offsetted frequency can also be used.

Further, the above description has been made with respect to one in which the photoelectric conversion element 216 does not move (the image sensor in the array form) in read-out for the image discrimination, but there is no need of limiting the element to the above one. For example, the following construction may be used: The main scanning is made by scanning an original 201 with a laser beam, and the reflected light from the original 201 is led through a light-guiding member such as an optical fiber, or a light-converging member, to a photosensor having a simple light-receiving area.

The above example is of a copying apparatus having an automatic original feed device, but it is also applicable to those generally used copying machines even if they are of the document glass plate movable type or fixed type. And there is no need of limiting their copying process to the ordinary Carlson process.

The copying method in this example enables the reproduction of an image free of background fog and also enables the tone conversion (histogram equalization), thus producing a well legible and high-density image, just as the previous example does.

Figures 14, 15:
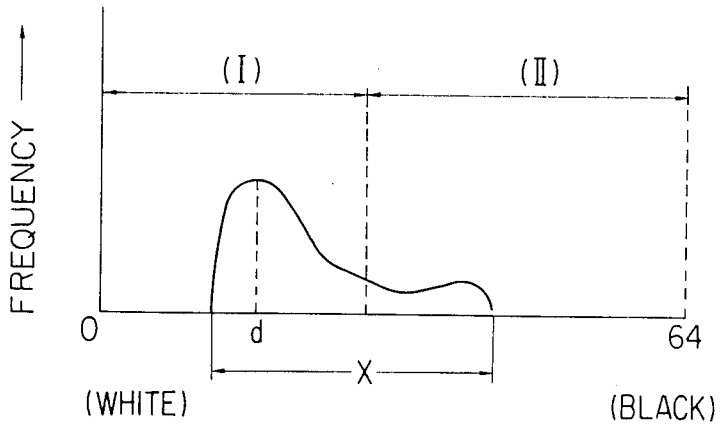
FIG. 14 is an explanatory drawing of a third example showing a table of selection of values for the density control.
FIG. 15 is an explanatory drawing of the low-density-side peak level density and histogram density width which are the basis for the discrimination in the developing process and of the principle of the discrimination in this invention.

A third example of the copying method of this invention will then be illustrated below:

In the copying apparatus shown in the foregoing FIG. 7, 218(III) is a process control section that receives an image discriminating signal Sb from the foregoing signal processing section 217(III) and determines the exposure and developing conditions based on the discriminating signal Sb. The process control section 218(III), in addition to the above, performs various controls such as the control of the feed operation of automatic document feeder 220, the control of the movement of read-out optical system 212, and the like. The controls by the process control section 218(III) of the exposure and developing conditions are accomplished by the controlling of quantity of light (Light source 212*a* is driven usually by a known light adjusting circuit comprising a trigger diode and triode AC switch (TRIAC). In this case, the quantity of light from light source 212*a* can be controlled by phase control) and the control of the developing bias voltage. FIG. 14 shows an example of the quantity of light Exp and the developing bias voltage $V_B$ in relative values, which the process control section 218(III) selects in accordance with a combination of (I) to (V) with (1) or (2) instructed by an image discriminating signal Sb. That is, as for the quantity of light Exp, the "L" in the table is used for a large quantity of light, the "N" for a medium quantity, and the "D" for a small quantity, and as to the developing bias voltage $V_B$, the "L" in the table is used for a low bias voltage, the "N" for a medium bias voltage, and the "H" for a high bias voltage. The table in FIG. 14 may be written in, e.g., ROM 2175, to let CPU 2173 produce the above values as setting values to the process control section 218, or inside the process control section 218 may be provided ROM in which is written the table of FIG. 14 to let CPU 2173 produce a signal showing a combination of (I) to (V) with (1) or (2). This invention is based on the latter construction.

The operation of the copying apparatus of the third example will be illustrated below:

Originals 201 are first placed on original supply tray 221, and when the copying start button (not shown) is depressed, process control section 218 returns optical scanning system 212 to the initial position thereof (the extreme left position in FIG. 7, i.e., the exposure-scanning start position), and at the same time rotates both original feed section 222 and transport belt 223 to transport original 201 and then stops the original 201 in the proper position at the upper end of stopper 233 that protrudes from the upper face of document glass plate 211, and also stops the rotation of transport belt 223. During this transport, both photoelectric conversion element 216 and signal process section (unit) 217 discriminate the image of original 201. That is, the photoelectric conversion element 216 converts the light-quantity signal into an electric image signal Se, and the image signal Se is then sampled by sampling circuit 2171. The Se, an analog signal, is then converted by A/D converter 2172 into a digital signal. The digitalized signal Se is read out by CPU 2173. The CPU 2173, with the aid of memories 2174 and 2175, performs the preparation of the foregoing histogram and the image discrimination, and then produces an output of image discriminating signal Sb. The signal Sb is then fed into process control section 218. On the other hand, the setting of original 201 to the proper position also is performed by sensor 235 at the same time, and a signal telling this also is fed into process control section 218. Upon the input of the above two signals to process control section 218(III), the process control section 218(III) provides a given charge current (surface potential) to the drum, and from light source 212*a* a light of a given intensity based on the image discrimination is emitted and projected upon the original 201 (the light emission is allowed to start before it), and the reflected light from the original 201 is led through mirrors 212*b* and lens 212*c* onto photoreceptor drum 213, whrerby an electrostatic latent image is formed on the drum. The latent image is then developed in developing section 215, with the application of a developing bias voltage based on the results of the image discrimination, and after that, the transfer of the toner image onto a copy sheet (not shown), separation of the copy sheet from the photoreceptor drum 213, and fixing (fusing) of the toner image to the sheet are performed, whereby one cycle of the copying process is completed. On the other hand, in parallel with the developing, separation and fixing operations, the process control section 218, after exposure, moves the upper end of stopper 233 downward from the upper face of document glass plate 211, and again rotates transport belt 223 to eject the copying-completed original 201 onto ejected original-receiving tray 234, and at the same time commences the transport of a new original 201 to set it to the correct position to thereafter repeat the copying operation cycle until the completion of the copying of all the originals 201 stacked on original supply tray 221.

Incidentally, the foregoing FIG. 11 is indicated also as a drawing showing the relations between the original image density and the copy image density when the quantity of light and developing bias voltage are varied, and FIG. 12 is a drawing showing for reference the relations between the surface potential and the original image density when the quantity of light is varied. The solid-line curves in FIG. 11 show the characteristics in the case where the quantity of light is large, while the broken-line curves show the characteristics when the quantity of light is small. The curves with the ● are for a high bias voltage, the ones with the ○ for a medium bias voltage, and the ones w1th the Δ for a low bias voltage. On the other hand, the solid-line curves and the broken-line curves in FIG. 12 show the characteristics in two different settings, wherein the curves with the ● are for a large quantity of light, the ones with the ● for a medium quantity, and the ones with the x for a small quantity. From FIG. 11 it is undeterstood that the higher the bias voltage, the higher the density of the area from which the development starts, and the larger the quantity of light, the more conspicuous the fade-out in the low-density of the image. Also from FIG. 12 it is understood that if the black original copying electric potential is increased, a rapid change in the potential occurs in the low-density area. This tendency increases with the increase in the quantity of light.

According to the above copying apparatus, for example, in the case where the peak density d on the low-density side is low and the histogram density width X is narrow, i.e., in the case of FIG. 6(A) (low-density or color-background line drawing), the image discrimination is to be made by the selection of a combination of any one of (I) to (III) with (2), and the copying operation is to be performed on condition that:

(1) the quantity of light is set to a medium or slightly high level, and (2) the developing bias voltage is set to a medium or slightly low level, whereby fog-free, histogram equalization-treated copies can be obtained {see FIG. 6(B)}.

And, for an original image showing a histogram shifted toward the high-density side, a combination of (IV) or (V) with (2) is to be selected and thus histogram equlization where the high-density area is extended toward the low-density side is to be performed, whereby the image will never be of a solid-black copy.

In addition, the above description has been made with respect to the finding of the peak density on the low-density side (the density corresponding to the peak produced on the low-density side of the histogram) and the histogram density width only, but it is possible also to find other peak densities in addition to them. According to this method, the image discriminating accuracy can be improved, for example, it enables a histogram equalization that extends the high-density area of a gradational image rich in high-density details (also containing low-density details) toward the low-density side. And not only the peak density but the peak value of the histogram may be found to be provided for the image discrimination. By doing so, the principal density (the density of the desired details) of the image can be recognized well, whereby the copying operation wherein the histogram equalization is concentrated upon the principal density can be performed.

Also, as the histogram density width in the above description a width where is made at a given frequency may also be used.

Further, the above description has been made with respect to one in which the photoelectric conversion element 216 does not move (the image sensor in the array form) in the read-out for the original image discrimination, but there is no need of limiting the element to the above one. For example, the following construction may also be used: The main scanning is made by scanning an original 201 with a laser beam, and the reflected light from the original 201 is led through a light-leading member such as an optical fiber, or a light-converging member to a photosensor having a simple light-receiving area.

The above example is of a copying apparatus having an automatic original feed device, but it is also applicable to those generally used copying machines even if they are of the document glass plate movable or fixed type. And there is no need of limiting their copying process to the ordinary Carlson process.

The copying method in this third example enables the reproduction of an image free of background fog and also enables the tone conversion (tone correction), thus producing a well legible and good-quality image, just as the previous examples do.

A fourth example of the copying method of this invention will now be illustrated below:

In the copying apparatus shown in FIG. 7, 218(IV) is a process control section that receives an image discriminating signal Sb from the foregoing signal process section 217(IV) and determines the exposure condition. The process control section 218(IV), in addition to the above, performs various controls such as the control of the feed operation of automatic document feeder 220, the control of the movement of optical system 212, and the like. The control by the process control section 218(IV) of the exposure condition is accomplished by the control of the quantity of light (Light source 212*a* is driven usually by a known light adjusting circuit comprising a trigger diode and triode AC switch, etc. In this case, the quantity of light from light source 212*a* can be controlled by phase control). FIG. 16 shows an example of the quantity of light Exp which the process control section 218(IV) selects according to a combination of (I) or (II) with (1) or (2) instructed by image discriminating signal Sb, and the Exp is indicated in relative values. That is, the "L" in the table is used for a large quantity of light and the "N" for a medium quantity of light. The table in FIG. 16 may be written in, e.g., ROM 2175 to let CPU 2173 produce an output of the above values as setting values to process control section 218, or inside the process control section 218 may be provided ROM in which is written the table of FIG. 16 to let CPU 2173 produce an output of a signal showing a combination of (I) or (II) with (1) or (2). The description in this invention is based on the latter construction.

The operation of the copying apparatus according to the fourth example will be illustrated.

Originals 201 are first placed on original supply tray 221, and when the copying start button (not shown) is depressed, process control section 218 returns optical scanning system 212 to the initial position thereof (the extreme left position in FIG. 7, i.e., the exposure-scanning start position), and at the same time rotates both original feed section 222 and transport belt 223 to transport original 201 and then stops the original 201 in the proper position at the upper end of stopper 233 that protrudes from the upper face of document glass plate 211, and also stops the rotation of transport belt 223. During this transport, both photoelectric conversion element 216 and signal processing section 217 discriminate the image of original 201. That is, the photoelectric conversion element 216 converts the light-quantity signal into an electric image signal Se, and the image signal Se is then sampled by sampling circuit 2171. The signal Se, an analog signal, is then converted by A/D converter 2172 into a digital signal. The digitalized signal Se is read out by CPU 2173. The CPU 2173, with the aid of memories 2174 and 2175, performs the preparation of the foregoing histogram and the image discrimination, and then produces an output of image discriminating signal Sb. The signal Sb is then fed into process control section 218. On the other hand, the setting of original 201 to the proper position also is performed by sensor 235 at the same time, and a signal telling this also is fed into process control section 218. Upon the input of the above two signals to process control section 218(IV), the process control section 218(IV) provides a given charge current (surface potential) to the drum, and from light source 212*a* a light of a given intensity based on the image discrimination is emitted and projected upon the original 201 (the light emission is allowed to start before it), and the reflected light from the original 201 is led through mirrors 212*b* and lens 212*c* onto photoreceptor drum 213, whereby an electrostatic latent image is formed on the drum. The laten image is then developed in developing section 215, and after that, the transfer of the toner image onto a copy sheet (not shown), separation of the copy sheet from the photoreceptor drum 213, and fixing of the toner image to the sheet are performed, whereby one cycle of the copying process is completed. On the other hand, in parallel with the developing, separation and fixing operations, the process control section 218, after exposure, moves the upper end of stopper 233 downward from the upper face of document glass plate 211, and again rotates transport belt 223 to eject the copying-completed original 201 onto ejected original-receiving tray 234, and at the same time commences the transport of a new original 201 to set the original to the correct position to thereafter repeat the copying operation cycle unitl the completion of the copying of all the originals 201 stacked on original supply tray 221.

Incidentally, the foregoing FIG. 11 is indicated also as a drawing showng the relations between the original image density and the copy image density when the quantity of light is varied, and FIG. 12 is a drawing showing the relations between the surface potential and the original density when the quantity of light is varied. The solid-line curves in FIG. 11 show the characteristics in the case where the quantity of light is large, while the broken-line curves show the characteristics when the quantity of light is small. The curves with the ● are for a high bias voltage, the ones with the ○ for a medium bias voltage, and the ones with Δ for a low bias voltage. On the other hand, the solid-line curves and the broken-line curves in FIG. 12 show the characteristics in two different settings, wherein the curves with the ○ are used for a large quantity of light, the ones with the ● for a medium quantity, and the ones with the x for a small quantity. From FIG. 11 it is understood that the larger the quantity of light, the more conspicuous the washout in the low-density area of the image. Also, from FIG. 12 it is understood that if the black original copying electric potential is increased, a rapid change in the potential occurs in the low-density area. This tendency increases with the increase in the quantity of light.

According to the above copying apparatus, for example, in the case where the peak density d on the low-density side is low and the histogram density width X is wide, the image discernment is to be made by the selection of a combination of (I) with (1), and the quantity of light becomes medium, but will be slightly large in a different case than the above. Since this distinction is made with the peak density d on the low-density side as a basis for the image discrimination, background fog can surely be prevented. Particularly, if the number of density ranges is selected to be not two as (I) and (II) but not less than three, the number of the levels of the quantity of light can be increased, and as a result, not only can the background fog be advantageously prevented but the density of line details can also be retained in a satisfactory condition. Further, since the histogram density width X is also used as a basis for the image discrimination, the reproduction of a tonal image can be improved. The histogram density width X may also be divided into not less than three ranges.

In addition, as the histogram density width in the above description. a width where is made at a given offsetted frequency may be used.

Further, the above description has been made with respect to one in which the photoelectric conversion element 216 does not move (the image sensor in the array form) in the readout for the original image discernment, but there is no need of limiting the element to the above one. For example, the following construction may also be used: The main scanning is made by scanning an original 201 with a laser beam, and the reflected light from the original 201 is led through a light-guiding member such as an optical fiber, or a light-converging member to a photosensor having a simple light-receiving area.

The above example is of a copying apparatus having an automatic original feed device, but it is also applicable to those generally used copying machines even if they are of the document glass plate movable or fixed type. And there is no need of limiting their copying process to the ordinary Carlson Process.

The copying method in this fourth example enables the reproduction of an image free of background fog and also enables the tone conversion, thus producing a well legible and good-quality image, just as the previous examples do.

A fifth example of the copying method of this invention will now be illustrated below:

In the copying apparatus shown in FIG. 7, 218(V) is a process control section that receives an image discriminating signal Sb from the foregoing signal processing section 217(V) and determines the developing condition based on the image discriminating signal Sb. The process control section 218(V), in addition to the above, performs various controls such as the control of the feed operation of automatic document feeder 220, the control of the movement of optical scanning system 212. The control of the developing condition by the process control section 218(V) is accomplished by the control of the developing bias voltage. FIG. 17 shows an example of the developing bias voltage $V_B$ which the process control section 218(V) selects in accordance with a combination of (I) or (II) with (1) or (2) instructed by the image discriminating signal Sb, and the "L" in the table is used for a low developing bias voltage $V_B$, the "N" for a medium bias voltage, and the "H" for a high bias voltage. The table in FIG. 17 may be written in, e.g., ROM 2175 to let CPU 2173 produce an output of the above values to process control section 218(V), or inside the process control section 218(V) may be provided ROM in which is written the table of FIG. 17 to let CPU 2173 produce an output of a signal showing a combination of (I) or (II) with (1) or (2). The description of this invention is based on the latter construction.

The operation of the copying apparatus according to this fifth example will now be illustrated below:

Originals 201 are first placed on original supply tray 221, and when the copying start button (not shown) is depressed, process control section 218 returns optical scanning system 212 to the initial position thereof (the extreme left position in FIG. 7, i.e., the exposure-scanning start position), and at the same time rotates both original feed section 222 and transport belt 223 to transport original 201 and then stops the original 201 in the proper position at the upper end of stopper 233 that protrudes from the upper face of document glass plate 211, and also stops the rotation of transport belt 223. During this transport, both photoelectric conversion element 216 and signal processing section 217 discriminate the image of original 201. That is, the photoelectric conversion element 216 converts the light-quantity signal into an electric image signal Se, and the image signal Se is then sampled by sampling circuit 2171. The signal Se, an analog signal, is then converted by A/D converter 2171 a digital signal. The digitalized signal Se is read out by CPU 2173. The CPU 2173, with the aid of memories 2174 and 2175, performs the preparation of the foregoing histogram and the image discrimination, and then produces an output of image discriminating signal Sb. The signal Sb is then fed into process control section 218. On the other hand, the setting of original 201 to the proper position also is performed by sensor 235 at the same time, and a signal telling this also is fed into process control section 218. Upon the input of the above two signals to process control section 218(V), the process control section 218(V) provides a given charge current (surface potential) to the drum, and from light source **212*a* a light of a given intensity is emitted and projected upon the original 201 (the light emission is allowed to start before it), and the reflected light from the original 201 is led through mirrors 212*b* and lens 212*c* onto photoreceptor drum 213, whereby an electrostatic latent image is formed on the drum. The latent image is then developed in developing section 215 under the application of a developing bias voltage based on the results of the image discrimination, and after that, the transfer of the toner image onto a copy sheet (not shown), separation of the copy sheet from the photoreceptor drum 213, and fixing of the toner image to the sheet are performed, whereby one cycle of the copying process is completed. On the other hand, in parallel with the developing, separation and fixing operations, the process control section 218, after exposure, moves the upper end of stopper 233 downward from the upper face of document glass plate 211, and again rotates transport belt 223 to eject the copying-completed original 201 onto ejected original-receiving tray 234, and at the same time commences the transport of a new original 201 to set the original to the correct position to thereafter repeat the copying operation cycle until the completion of the copying of all the originals 201 stacked on original supply tray 221**.

Incidentally, the foregoing FIG. 11 is indicated also as a drawing showing the relations between the original image density and the copy image density when the developing bias voltage is varied, and FIG. 12 is a drawing showing for reference the relations between the surface potential and the original image density when the quantity of light is varied. The solid-curves in FIG. 11 show the characteristics when the quantity of light is large, while the broken-line curves show the characteristics when the quantity of light is small. The curves with the ● are for a high bias voltage, the ones with the ○ for a medium voltage, and the ones with the Δ for a low voltage. On the other hand, the solid-line curves and the broken-line curves in FIG. 12 show the characteristics in two different settings, wherein the curves with the ○ are for a large quantity of light, the ones with the ● for a medium quantity, and the ones with the x for a small quantity. From FIG. 11 it is understood that the higher the developing bias voltage, the higher the density of the area from which the development starts, and the larger the quantity of light, the more conspicuous the washout in the low-density are of the image. Also, from FIG. 12 it is understood that if the black original copying electric potential is increased, a rapid change in the potential occurs in the low-density area. This tendency increases with the increase in the quantity of light.

According to the above copying apparatus, for example, in the case where the peak density d on the low-density side is low and the histogram density width X is narrow, the combination is of (I) with (2), and thus the developing bias voltage decreases to a low level, while in the case where the peak density d on the low-density side is high and the histogram density width X is wide, the combination is of (II) with (2), and thus the developing bias voltage increases to a high level, and in a different case than the above, the voltage becomes medium. Since this distinction is made with the peak density d on the low-density side as a basis for the discrimination, background fog can surely be prevented. Particularly, if the number of density ranges is selected to be not two as (I) and (II) but not less than three, the level number of the developing bias voltage can be increased, and therefore not only can the background fog be advantageously prevented but the condition of the density of line details can be statisfactorily retained. Also, because the histogram density width X is used as a basis for the image discrimination, the reproduction of a tonal image can be improved. The histogram density width X may also be divided into not less than three ranges.

In addition, as the histogram density width in the above description a width where is made at a give offset frequency can also be used.

Further, the above description has been made with respect to one in which the photoelectric conversion element 216 does not move (the image sensor in the array form) in the read-out for the original image discrimination, but there is no need of limiting the element to the above one. For example, the following construction may also be used: The main scanning is made by scanning an original 201 with a laser beam, and the reflected light from the original 201 is led through a light-guiding member such as an optical fiber, or a light-converging member to a photosensor having a simple light-receiving area.

The above example is of a copying apparatus having an automatic document feeder (original feeding device), but it is also applicable to those generally used copying machines even if they are of the document glass plate movable or fixed type. And there is no need of limiting their copying process to the ordinary Carlson Process.

The copying method in this fifth example enables the reproduction of an image free of background fog and also enables the tone conversion, thus producing a well legible and good-quality image, just as the previous examples do.

A sixth example of the copying method of this invention will now be illustrated below:

In the copying apparatus shown in the foregoing FIG. 7, 218(VI) is a process control section that receives a image discriminating signal Sb from the foregoing signal processing section 217(VI) and determines the charging and developing conditions based on the image discriminating signal Sb. The process control section 218(VI), in addition to the above, performs various controls such as the control of the feed operation of automatic document feeder 220, the control of the movement of optical scanning system 212, and the like. The controls of the charging and developing conditions by the process control section 218(VI) are accomplished by the control of the charge current (the surface potential of photoreceptor drum 213) and the control of the developing bias voltage. FIG. 18 shows an example of the surface potential Vs and developing bias voltage $V_B$ which the process control section 218(VI) selects according to a combination of (I) or (II) with (1) or (2) instructed by the image discriminating signal Sb. As for the surface potential Vs, two different voltages Vo and $V_1$ (to indicate an example of particular values, Vo=960 V and $V_1$=900 V) are indicated, and as to the bias boltage $V_B$, relative values are indicated. That is, the "N" in the table shows that the developing bias voltage is on a medium level, and the "H" shows that the voltage is high. The table in FIG. 18 may be written in, e.g., ROM 2175 to let CPU 2173 produce an output of the above values as setting values to process control section 218, or inside the process control section 218 may be provided ROM in which is written the above table of FIG. 18 to let CPU 2173 produce an output of a signal showing a combination of (I) or (II) with (1) or (2). The description of this invention is based on the latter construction.

The operation of the copying apparatus according to this sixth example will now be illustrated below:

Originals 201 are first placed on original supply tray 221, and when the copying start button (not shown) is depressed, process control section 218 returns optical scanning system 212 to the initial position thereof (the extreme left position in FIG. 7, i.e., the exposure-scanning start position), and at the same time rotates both original feed section 222 and transport belt 223 to transport original 201 and then stops the original 201 in the proper position at the upper end of stopper 233 that protrudes from the upper face of document glass plate 211, and also stops the rotation of transport belt 223. During this transport, both photoelectric conversion element 216 and signal processing section 217 discern the image of original 201. That is, the photoelectric conversion element 216 converts the light-quantity signal into an electric image signal Se, and the image signal Se is then sampled by sampling circuit 2171. The signal Se, an analog signal, is then converted by A/D converter 2171 into a digital signal. The digitalized signal Se is read out by CPU 2173. The CPU 2173, with the air of memories 2174 and 2175, performs the preparation of the foregoing histogram and the image discrimination, and then produces an output of image discriminating signal Sb. The signal Sb is then fed into process control section 218. On the other hand, the setting of original 201 to the proper position also is performed by sensor 235 at the same time, and a signal telling this also is fed into process control section 218. Upon the input of the above two signals to process control section(VI), the process control section 218(VI) provides a given charge current (surface potential) to the drum, and from light source 212*a* a light of a given intensity is emitted and projected upon the original 201 (the light emission is allowed to start before it), and the reflected light from the original 201 is led through mirror 212*b* and lens 212*c* onto photoreceptor drum 213, whereby an electrostatic latent image is formed on the drum. The latent image is then developed in developing section 215 under the application of a developing bias voltage based on the results of the image discrimination, and after that, the transfer of the toner image onto a copy sheet (not shown), separation of the copy sheet from the photoreceptor drum 213, and fixing of the toner image to the sheet are performed, whereby one cycle of the copying operation is completed. On the other hand, in parallel with the developing, separation and fixing operations, the process control section 218, after exposure, moves the upper end of stopper 233 downward from the upper face of document glass plate 211, and again rotates transport belt 223 to eject the copying-completed original 201 onto ejected original-receiving tray 234, and at the same time commences the transport of a new original 201 to set the original to the proper position to thereafter repeat the copying operation cycle until the completion of the copying of all the originals 201 stacked on original supply tray 221.

Incidentally, the foregoing FIG. 11 is indicated also as a drawing showing the relations between the original image density and the copy image density when the developing bias voltage is varied, and FIG. 12 is a drawing showing for reference the relations between the surface potential and the original image density when the quantity of light is varied. The solid-line curves in FIG. 11 show the characteristics when the quantity of light is large, while the broken-line curves show the characteristics when the quantity of light is small. The curves with the ● are for a high bias voltage, the ones with the ○ for a medium bias voltage, and the ones with the Δ for a low bias voltage. On the other hand, the solid-line curves and the broken-line curves in FIG. 12 show the characteristics in two different settings, wherein the curves with the ○ are for a large quantity of light, the ones with the ● for a medium quantity, and the ones with the x for a small quantity. From FIG. 11 it is understood that the higher the bias voltage the higher the density of the area from which the development starts, and the larger the quantity of light, the more conspicuous the fade-out in the low-density area of the image. Also, from FIG. 12 it is understood that if the black original copying electric potential is increased, a rapid change in the potential occurs in the low-density area. This tendency increases with the increase in the quantity of light.

According to the above copying apparatus, for example, in the case where the peak density d on the low-density side is low and the histogram density width X is narrow, i.e., in the case of FIG. 6(A) (low-density, color-background line drawing), the image discrimination is to be made with the selection of a combination of (I) with (2), and the copying is to be made on condition that:

(1) the surface potential of the drum is set to a low level ($V_1$), and (2) the development bias voltage is set to medium level, whereby fog-fee, histogram equalization-treated copies can be obtained {see FIG. 6(B)}.

And, for an original image showing a histogram shifted toward the high-density side, a combination of (II) with (2) is selected, and thus a histogram equalization which extends the high-density area toward the low-density side is performed, whereby the image will never be of a solid-black copy.

The above description has been made with respect to the finding of the peak density on the low-density side and the histogram density width only, but it is also possible to find other peak densities along with them. According to this method, the image discriminating accuracy can be improved, for example, it is possible to perform a histogram equalization that extends the high-density area of a gradational image rich in high-density details (also containing low-density details) toward the low-density side. And not only the peak density but the peak value of the histogram may be found to be provided for the image discrimination. By doing so, because the principal density (the density of the desired part) of the image can be recognized well, the copying operation can be carried out with the histogram equalization concentrated upon the desired part.

And, as the histogram density width in the above description a width where is made at a given offset frequency may also be used. In the above, the cases of the image discrimination made with use of (I), (II), (1) and (2) divisions have been described, but if the number of such divisions is increased to thereby increase the number of levels of the surface potential and developing bias voltage, the reproduction of the image can be further improved.

Further, the above description has been made with respect to one in which the photoelectric conversion element 216 does not move (the image sensor in the array form) in the read-out for the original image discrimination, but there is no need of limiting the element to the above one. For example, the following construction may also be used: The main scanning is made by scanning an original 201 with a laser beam, and the reflected light from the original 201 is led through a light-guiding member such as an optical fiber, or a light-converging member to a photosensor having a simple light-receiving area.

The above example is of a copying apparatus having an automatic document feeder, but it is also applicable to those generally used copying machines even if they are of the document glass plate movable or fixed type. And there is no need of limiting their copying process to the ordinary Carlson process.

As has been described above, in the copying method according to the examples of this invention, since the peak density on the low-density side can be accurately found by the fine quantization thereof, a correct image discrimination can be carried ot through the judgement on what background density level the image has, and therefore the image reproduction can be performed without producing any background fog. Further, since the tone conversion is also possible, a well legible and good-quality image can be obtained.

What is claimed is:

1. A method of discriminating a density characteristic of an image which comprises:

scanning an original image with a photoelectric conversion device, quantizing an image signal based upon the output obtained through the photoelectric conversion device, preparing a density histogram representing effective reflection density on one axis and frequency on another axis corresponding to said quantized image signal, detecting a peak density value corresponding to a peak present on said density histogram relative to the effective reflection density axis of said histogram, and detecting a density width value for a range of reflection density values covered by said density histogram, and discriminating said original image according to both said peak density value and said density width value.

2. The method of discriminating an image of claim 1, wherein a quantization level of said quantizing is finely set on a low-density side in said image signal.

3. The method of discriminating an image of claim 2, wherein said low-density side range is selected to cover densities not more than about 0.8.

4. The method of discriminating an image of claim 2, wherein said scanning is made with the spot area selected to be not less than 0.1 $mm^2$.

5. The method of discriminating an image of claim 2, wherein said quantizing is made by sampling at constant time intervals the image signal from said photoelectric conversion device.

6. The method of discriminating an image of claim 2, wherein said peak frequency value of said density histogram is provided for said image discrimination.

7. The method of discriminating an image of claim 2, wherein as said density width of said density histogram a width at a given offset frequency is used.

8. The method of discriminating an image of claim 1, wherein said detecting step includes detecting a peak density value on a low density side of the histogram when plural peaks are present.

9. A method of copying an image which comprises:

scanning an original image with a photoelectric conversion device, quantizing an image signal based upon the output obtained through said photoelectric conversion device, preparing a density histogram representing effective reflection density on one axis and frequency on another axis corresponding to said quantized image signal, detecting a peak density value corresponding to a peak present on said density histogram relative to the effective reflection density axis of said histogram, and detecting a density width value for a range of reflection density values covered by said density histogram, and controlling at least one of, or a combination of, the setting values of the conditions of the charging, exposure, and developing processes according to both said peak density value and said density width value of the density histogram.

10. The method of copying an image of claim 9, wherein said setting value of the condition of at least one of said charging, exposure, and developing processes is selected from a plurality of setting values in advance prepared, said selection being made with use of both said peak density value and said histogram density width as parameters.

11. The method of copying an image of claim 10, wherein said condition of said charging process is set with a value of charge current.

12. The method of copying an image of claim 10, wherein said condition of said exposure process is set with the quantity of light in exposure.

13. The method of copying an image of claim 10, wherein said condition of said developing process is set with a developing bias voltage.

14. The method of copying an image of claim 9, wherein said copying of an image is performed in accordance with the conditions of said charging and exposure processes determined according to said peak density value and said density width.

15. The method of copying an image of claim 9, wherein said copying of an image is performed in accordance with the conditions of said exposure and developing processes determined according to said peak density value and said density width.

16. The method of copying an image of claim 9, wherein said copying of an image is performed in accordance with the condition of said exposure process determined according to said peak density value and said density width.

17. The method of copying an image of claim 9, wherein said copying of an image is performed in accordance with the condition of said developing process determined according to said peak density value and said density width.

18. The method of copying an image of claim 9, wherein said copying of an image is performed in accordance with the conditions of said charging and developing processes determined according to said peak density value and said density width.

19. The method of copying an image of claim 9, wherein a quantization level of said quantizing is finely set on a low-density side in said image signal.

20. The method of copying an image of claim 19, wherein said low-density side range is selected to cover densities of not more than about 0.8.

21. The method of copying an image of claim 9, wherein said scanning is made with the spot area selected to be not less than 0.1 $mm^2$.

22. The method of copying an image of claim 9, wherein said quantizing is made by sampling at constant time intervals the image signal from said photoelectric conversion device.

* * * * *